US008051530B2

(12) United States Patent
Jeff et al.

(10) Patent No.: US 8,051,530 B2
(45) Date of Patent: Nov. 8, 2011

(54) SQUEEGEE ASSEMBLY AND METHOD OF USING SAME

(75) Inventors: Oberlin Jeff, Fruitport, MI (US); David W. Eickholt, Kentwood, MI (US)

(73) Assignee: Tennant Company, Minneapolis, MN (US)

( * ) Notice: Subject to any disclaimer, the term of this patent is extended or adjusted under 35 U.S.C. 154(b) by 961 days.

(21) Appl. No.: 11/942,628

(22) Filed: Nov. 19, 2007

(65) Prior Publication Data

US 2008/0216279 A1 Sep. 11, 2008

Related U.S. Application Data

(60) Provisional application No. 60/866,413, filed on Nov. 17, 2006.

(51) Int. Cl.
*A47L 11/29* (2006.01)

(52) U.S. Cl. ..... 15/320; 15/322; 15/401

(58) Field of Classification Search ..... 15/320–322, 15/401; *A47L 11/29*
See application file for complete search history.

(56) References Cited

U.S. PATENT DOCUMENTS 4,226,317 A * 10/1980 Nagano et al. ..... 192/64
5,819,366 A * 10/1998 Edin ..... 15/322

* cited by examiner

*Primary Examiner* — David Redding
(74) *Attorney, Agent, or Firm* — Briggs and Morgan, P.A.

(57) ABSTRACT

A squeegee blade assembly and method of use for a floor surface maintenance machine. A blade/guide subassembly is inserted into a channel of a scrub head prior to operation. During operation, the subassembly is retained with the channel via friction and/or protruding structures. During a blade exchange procedure, the subassembly is retracted from the channel prior to separation of the blade from the guide. Interaction with a protruding structure within the channel signals to an operator that the subassembly has been properly positioned.

15 Claims, 6 Drawing Sheets

443 Scrubber

SQUEEGEE ASSEMBLY AND METHOD OF USING SAME

RELATED APPLICATIONS

This application claims priority under 35 U.S.C. 119(e) from provisional U.S. Patent Application No. 60/866,413, filed Nov. 17, 2006, the contents of which are incorporated herein by reference.

FIELD OF THE INVENTION

The present invention relates generally to surface cleaning devices and more particularly to a floor surface cleaning device utilizing a liquid cleaning solution and a vacuum system for recovering soiled solution from a floor surface.

BACKGROUND OF THE INVENTION

Floor maintenance scrubbers are well known. These devices typically include a source of cleaning solution, solution applying means for distributing cleaning solution onto the floor surface, scrubbing means for engaging a wetted floor surface and a vacuum system for removing soiled cleaning solution from the floor surface. The vacuum system typically includes one or more squeegee elements, such as disclosed in U.S. Pat. Nos. 6,895,633; 6,705,332 and 6,602,018, each being incorporated by referenced herein. The squeegee blades in these types of machines are often a wear/service item. As the blades wear, the ability of the machine to pick up soiled cleaning solution and/or water is diminished. In some particularly harsh environments, squeegee blades are replaced multiple times during the life of the machine. Many times this is done by the operator in the field where the availability of tools is limited. Some prior art machines provide thumb screws for retaining the squeegee blades.

Tennant Company's model 433 Walk Behind Scrubber has included removable squeegee blades and retainers, similar to the design of FIG. 6. In this design, the retainers and blades are connected together via fasteners. The design purportedly provided for tool-less blade exchange by increasing the clearance around the blades, so the blades could be pushed or pulled within a retainer-receiving channel. Two significant limitations have been associated with this approach. First, since the soft rubber blade was not supported along its length it tended to bend during insertion into the channel. Additionally, when the blade was pulled, a portion of the blade tended to grab channel walls. Furthermore, the friction between rubber and aluminum was often too great to allow free sliding without increasing the clearances between the rubber and aluminum parts.

Another problem of the prior art has been bonding of the rubber blade to the aluminum or plastic retainer. Compression of the rubber blade within the retainer often resulted in adherence of the blade material to the retainer. Blade sticking made removal difficult without unscrewing the retainer.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

SUMMARY OF THE INVENTION

The present invention relates to a squeegee assembly and method of engaging a blade subassembly within a scrub head or other structure. In one embodiment, a subassembly of squeegee blade and channel guide are together movably retained within a channel of the scrubber head, with the subassembly being selectively released from the channel during a blade exchange procedure.

A method of engaging squeegee blades with a scrubber head is also disclosed. In one embodiment, the squeegee blades and channel guide subassembly are inserted into a channel of the scrub head until contact with a distal protrusion at an opposite end of the channel. Contact with a proximal protrusion may be released just prior to the contact with the distal protrusion, signaling to an operator that the blade/guide subassembly has been properly inserted into the channel.

DETAILED DESCRIPTION OF THE INVENTION

Figure 1:
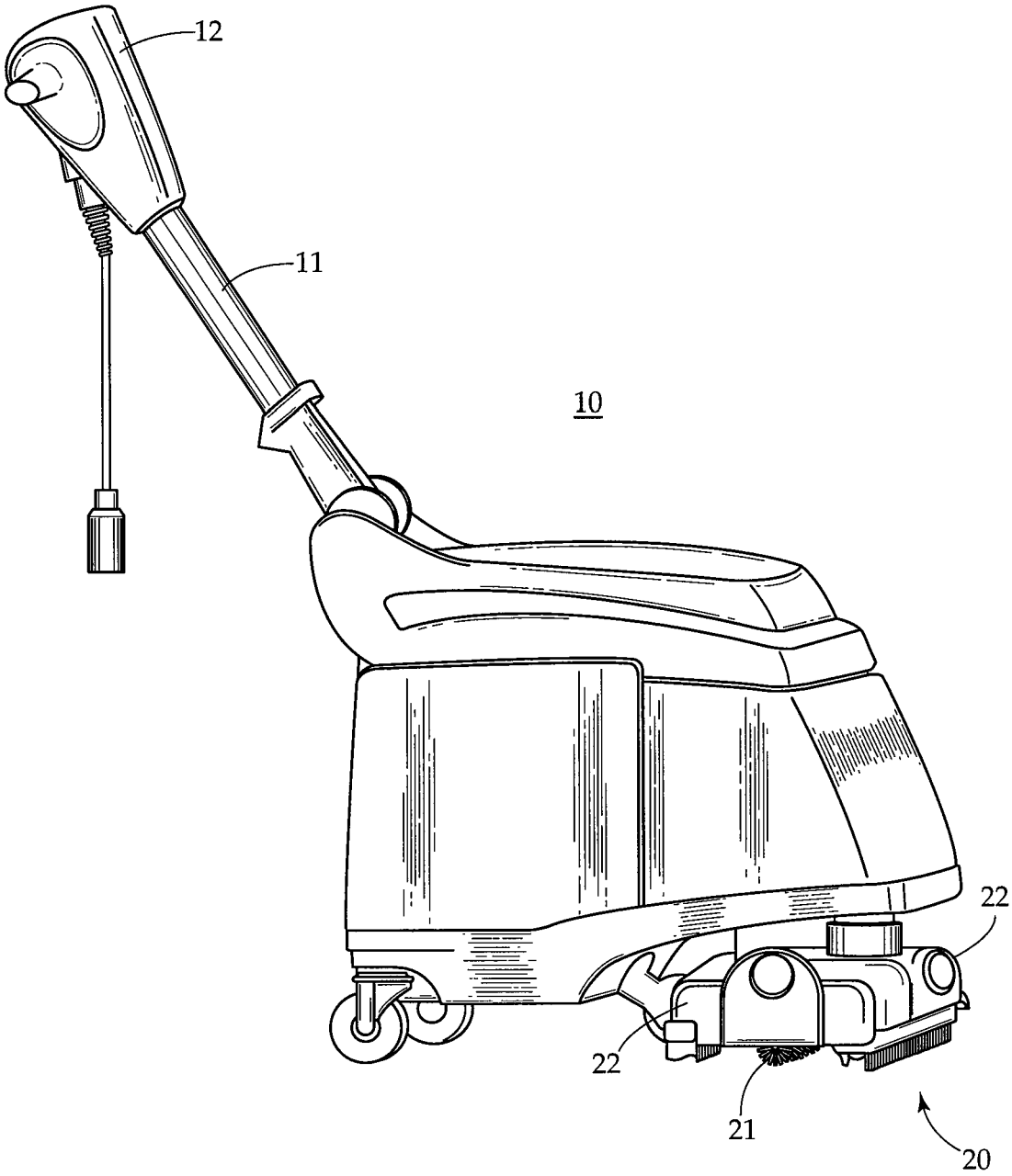
FIG. 1 is an elevational view of scrubber machine embodying the principles of the present invention.

FIG. 1 illustrates a scrubber machine 10 incorporating aspects of the present invention. Scrubber 10 includes handle 11, operator control 12, and clean and soiled cleaning solution tanks (not shown). Scrubber 10 also includes a vacuum fan (not shown) in fluid communication with scrub head 20 having a powered scrub brush 21 rotating between a pair of squeegee blade assemblies 22.

Figure 2:
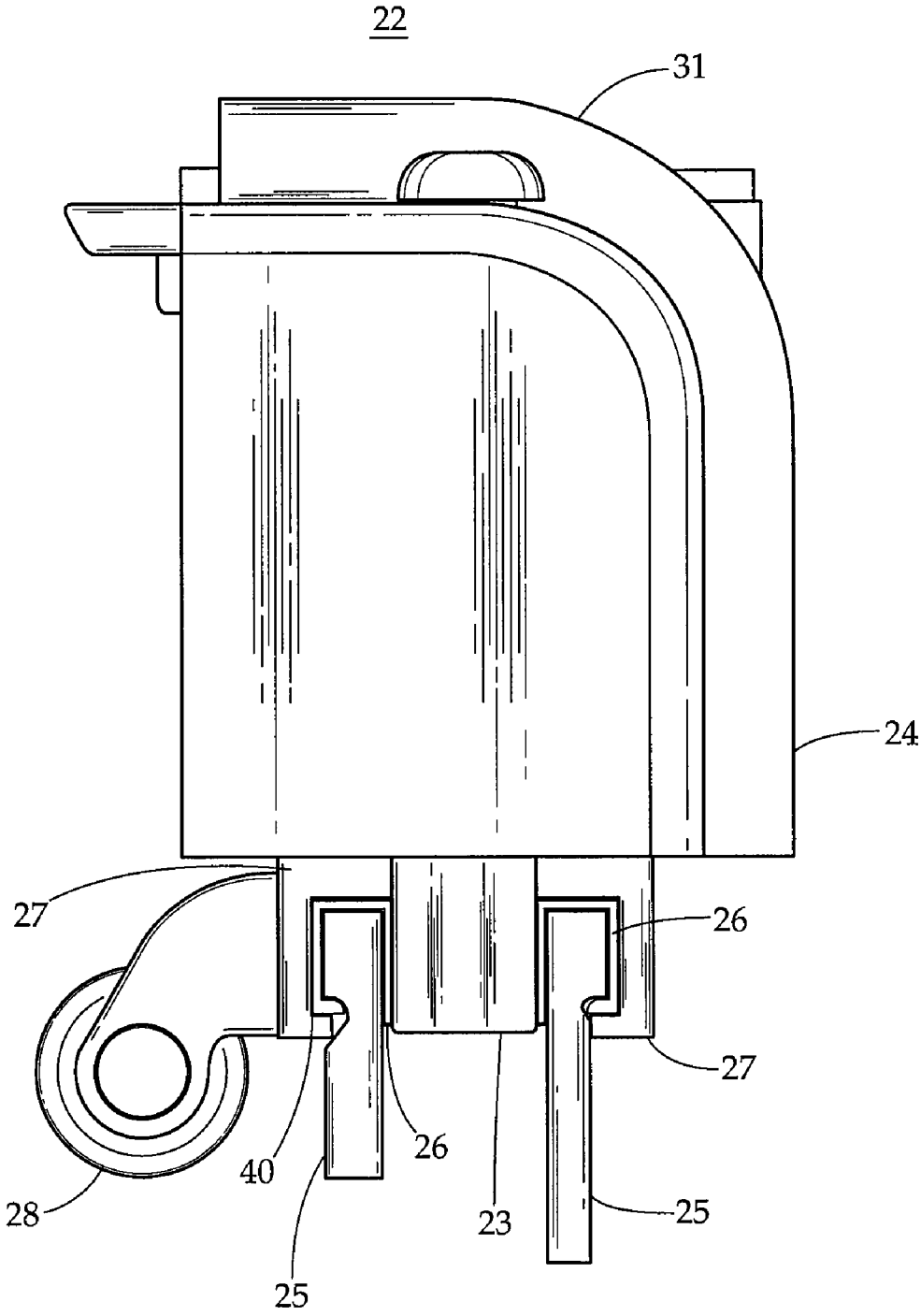
FIG. 2 is a side elevational view of a scrub head subassembly of the scrubber machine of FIG. 1.
Figure 3:
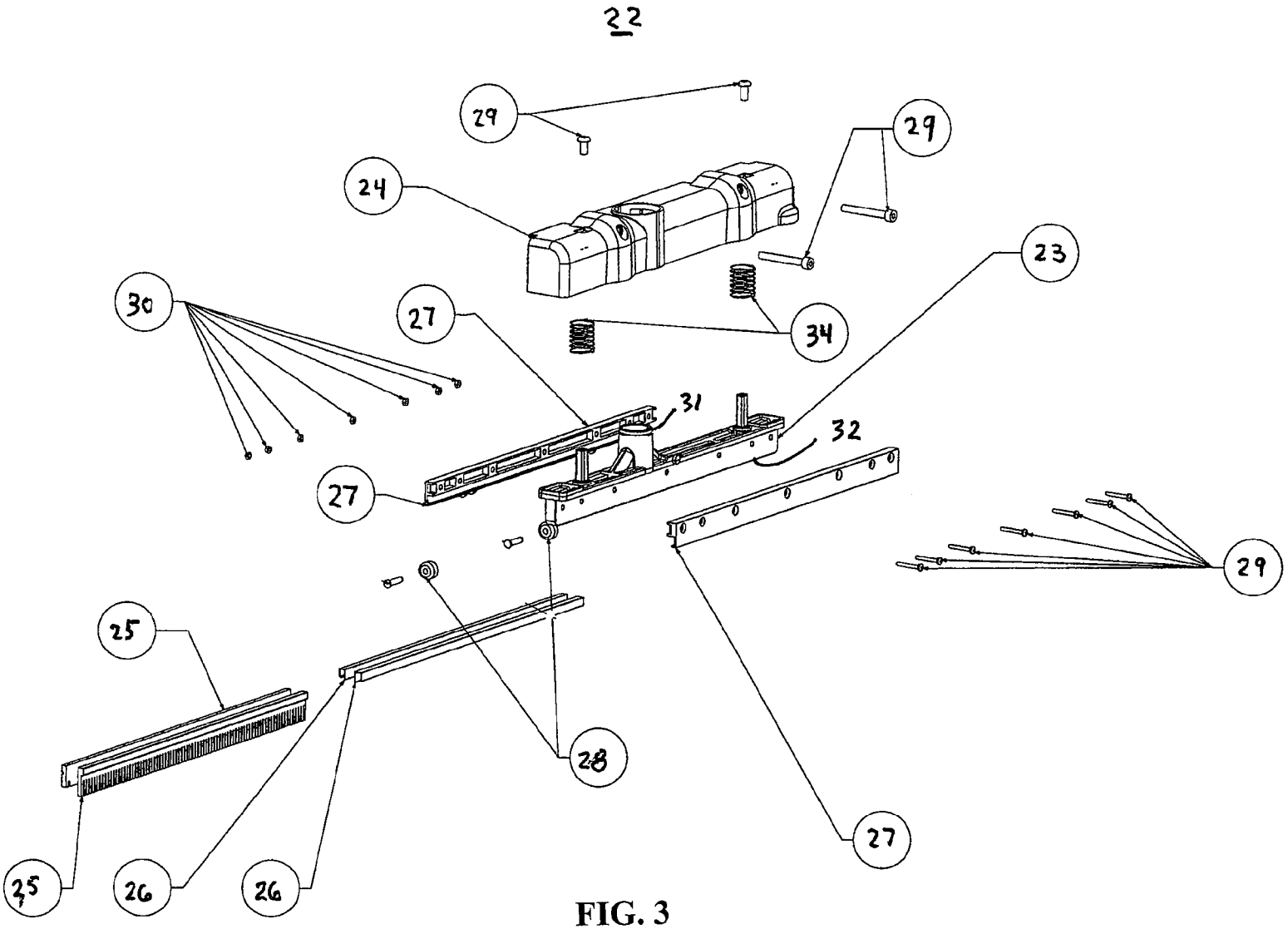
FIG. 3 is a perspective illustration of a disassembled squeegee blade assembly of FIG. 2.

FIG. 2 is a detailed side elevational view of squeegee blade assembly 22. FIG. 3 illustrates squeegee blade assembly 22 in a disassembled perspective view. Assembly 22 includes chassis 23, cover 24, squeegee blades 25, guides 26 and blade retainers 27. Wheels 28 support blade assembly 22 upon a ground surface during use. Assembly 22 is held together with fasteners including threaded fasteners 29, and nuts 30. Chassis 23 includes a vacuum tube outlet 31 adapted to be connected to a vacuum tube (not shown) in communication with the vacuum fan. End 32 of chassis 23, which is opposite outlet 31, is open to allow air and soiled cleaning solution to pass through outlet 31 and into the vacuum tube. Blades 25 may be differently configured and/or sized, as shown in FIG. 2. For example, a front blade 25 may include corrugations and be longer (in a vertical direction) than the rear blade. The front blade 25 may also be more compliant than the rear blade.

To permit some movement between chassis 23 and cover 24, chassis 23 is positioned internal to cover 24 under an internal spring load supplied by springs 34. During use, springs 34 provide a spring bias tending to displace chassis 23 away from cover 24. This movable connection between cover 24 and chassis 23 permits blades 25 to follow undulations or other irregularities upon the floor surface.

While the figures illustrate blade assembly 22 positioned relative to a forward-mounted scrub brush 21, the blade assembly 22 may also find application to rear-mounted structure. As a result, aspects of the present invention may be embodied on a rear-mounted squeegee assembly for a floor cleaning machine.

Figure 4:
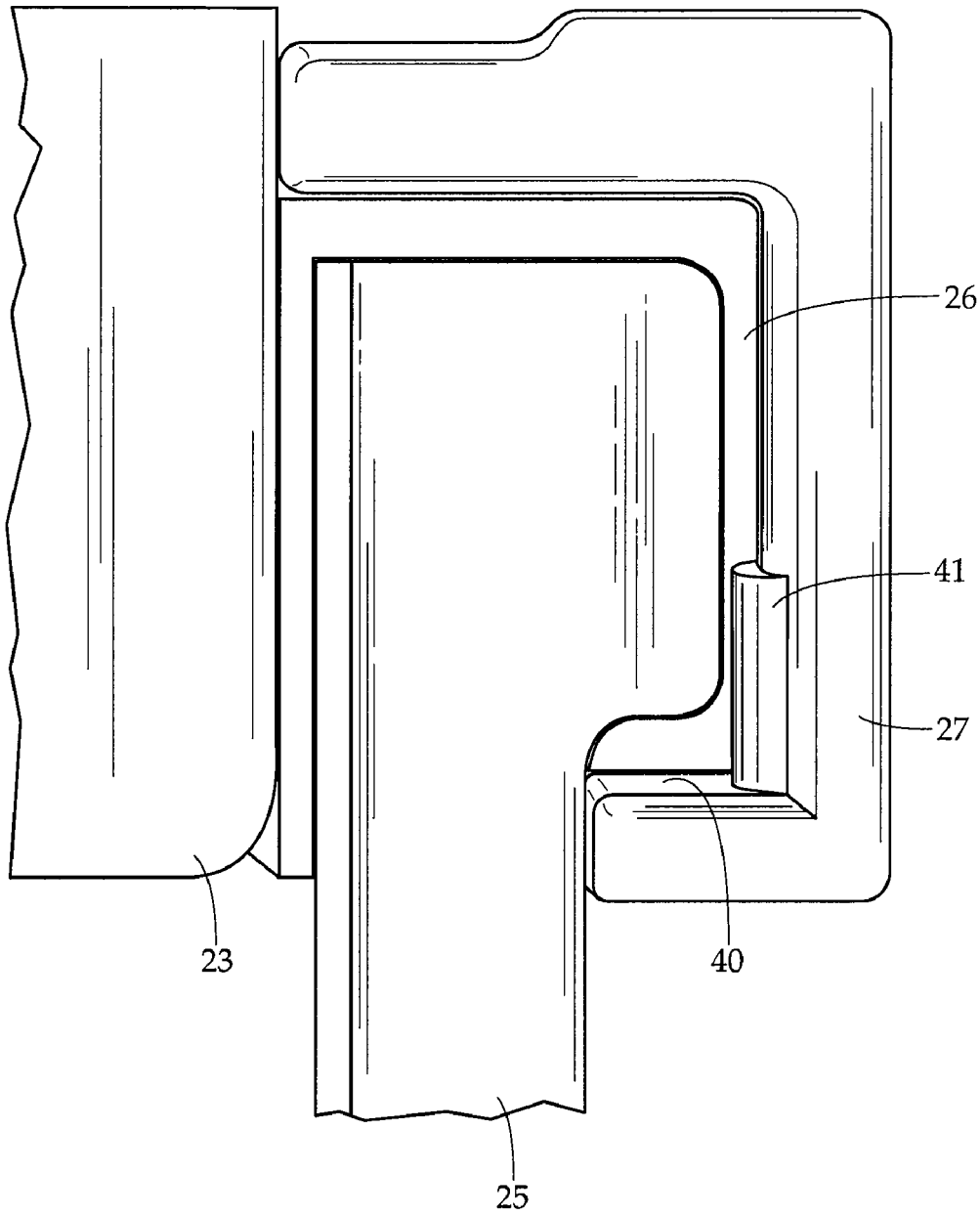
FIG. 4 is a detailed side view of the scrub head of FIG. 2.

Referring now to FIG. 4, a detailed side view of the squeegee blade assembly of FIG. 2 is shown. In the illustrated embodiment, guide 26 has been inserted into channel 40 formed by a portion of retainer 27 and chassis 23. An amount of clearance between guide 26 and retainer 27 permits guide 26 to move within channel 40 in a lateral direction (side-to-side motion relative to machine direction of travel) as well as other directions. To retain guide 26 within channel 40 during guide 26/blade 25 movement, protrusion 41 is sized to engage guide 26 and limit further lateral travel of guide 26. A similar protrusion (not shown) is positioned at the other end of channel 40. Channel 40 is generally G-shaped and a portion of channel 40 engages a groove of blade 25.

Figure 5:
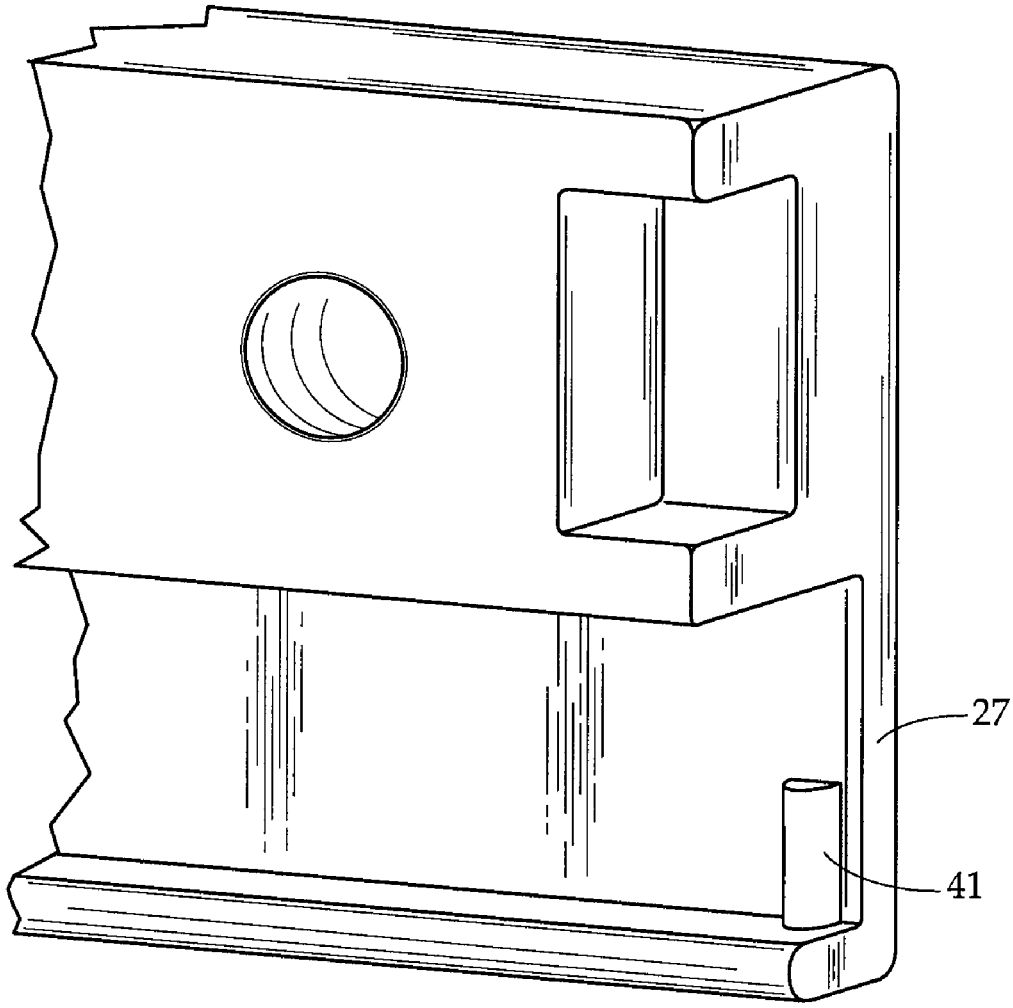
FIG. 5 is a detailed perspective view of a retainer utilized in the assembly of FIG. 2.
Figure 6:
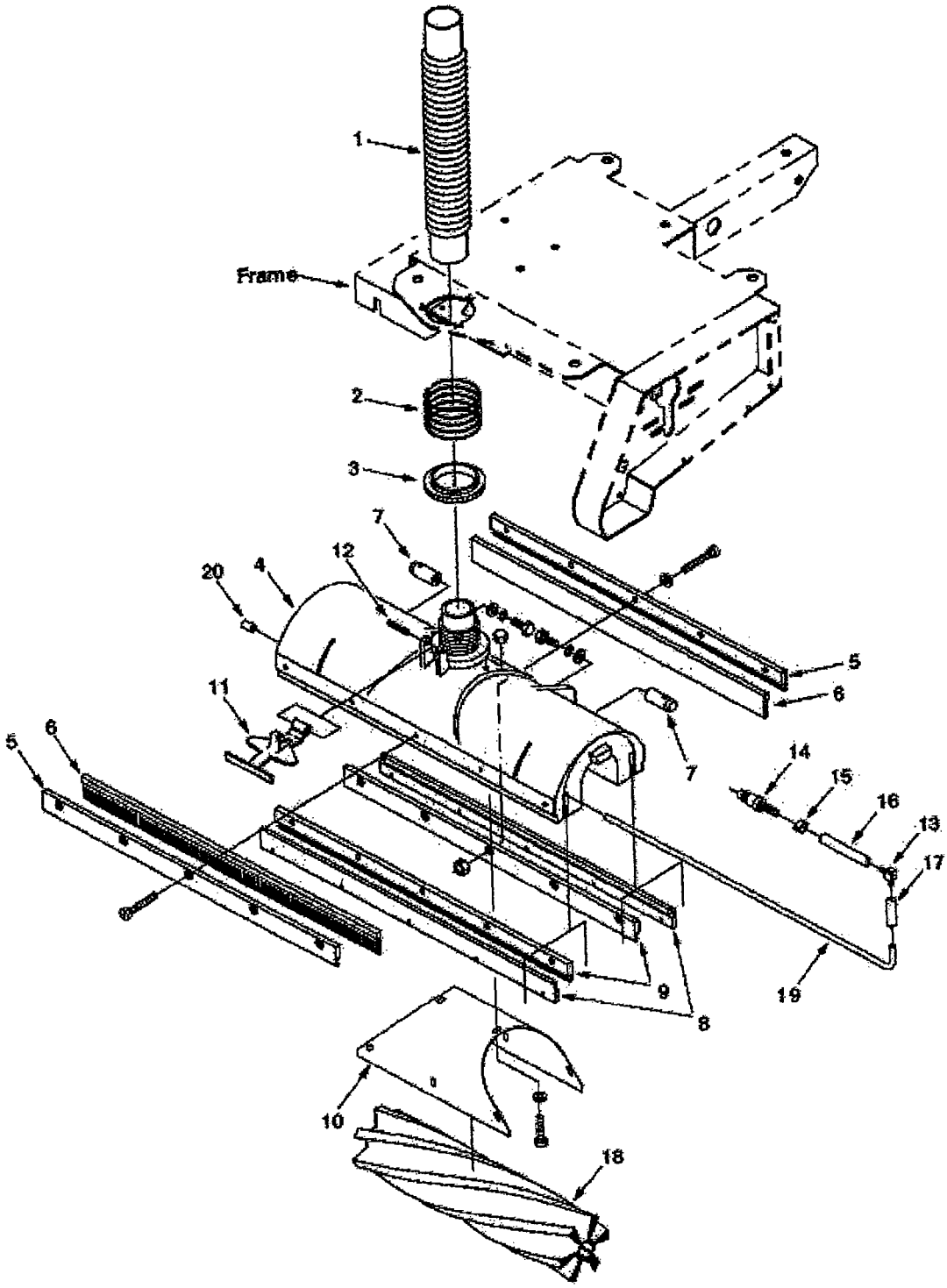
FIG. 6 is an exploded perspective view illustration showing components of a prior art scrub head.

FIG. 5 is a detailed view of an end of retainer 27 showing protrusion 41. Protrusions 41 are sized to permit guide 26 to be introduced into channel 40 during blade insertion while also restraining guide 26 within channel 40 during intended operation of scrubber 10. During a blade exchange procedure, protrusion 41 locally compresses guide 26 and blade 25. The height of protrusion 41 may be optimized to concentrate the load during insertion/retraction on the most compliant portion of the subassembly, relatively soft squeegee blade 25.

When blades 25 are to be replaced on scrubber 10, an operator may tip scrubber 10 upwardly to expose the bottom of scrub head 20. The operator can then grab and slide the blade 25/guide 26 subassembly out of channel 40. This extraction procedure is facilitated by the low friction interface between guide 26 and retainer 27. The interface between the blade/channel subassembly and retainer 27 is optimized with slight clearance to allow for lateral movement under expected tolerance conditions. Guide 26 provides rigidity to the subassembly, so it can be pushed into and pulled out of channel 40 with consistency. In one embodiment, blades 25 and guides 26 could be provided as disposable wear items.

Once the blade/channel assembly is in the proper position, protrusions 41 are exposed in the assembly as shown in FIGS. 4 and 5. During a blade exchange procedure, as the blade/guide subassembly is inserted into channel 40, an operator would initially sense contact between protrusion 41 and guide 26, followed by a release and a reduced drag signaling that the subassembly has been fully inserted to its proper position.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim:

1. A portable floor scrubber having a cleaning solution tank and a recovery tank and a squeegee blade assembly comprising:

a squeegee blade;

an elongated guide having an interior region which engages a portion of the squeegee blade; and a retainer connected to a chassis of the scrubber and defining at least a portion of a guide channel-receiving cavity, said elongated guide adapted to be inserted into the cavity during a squeegee blade exchange procedure, and said retainer including a protruding structure provided at one end of the retainer, wherein the protruding structure is sized to engage and deflect the guide and compress the blade as the blade and guide are inserted into or removed from the channel.

2. A method of exchanging a squeegee blade from a scrub head of a floor maintenance machine, said method comprising:

pulling on a blade and guide subassembly in a generally transverse direction relative to the direction of forward operational motion of the machine, said pulling causing the subassembly to deflect upon contact with a protruding structure while the subassembly is pulled out of a channel of the scrub head; and inserting a new blade and guide subassembly into the channel of the scrub head, said inserting continuing until the subassembly engages a stop.

3. The method of claim 2 wherein the channel is defined between a blade retainer and a chassis of the scrub head.

4. The method of claim 2 wherein subsequent to said inserting, the blade and guide subassembly freely slides within the channel during intended operation of the floor maintenance machine, with the stop and the protruding structure acting to retain the blade and guide subassembly within the channel.

5. The method of claim 2 wherein said inserting results in a compression of the subassembly by the protruding structure prior to a release signaling to an operator that the subassembly has reached an intended position.

6. A scrub head for a floor maintenance machine comprising:

a chassis;

a retainer coupled to the chassis, said retainer and chassis defining a channel; and a squeegee blade adapted to engage an interior structure of a guide, wherein the guide is significantly less compliant than the squeegee blade so as to provide a relatively rigid guide and blade subassembly, and wherein blade and guide subassembly is sized to be inserted into and retained within the channel prior to machine operation and to be removed from the channel during a blade exchange procedure, wherein a protruding structure is provided at one end of the retainer.

7. The scrub head of claim 6 further comprising a blade stop which limits a range of motion of the blade and guide subassembly within the channel.

8. The scrub head of claim 7 wherein the blade stop is a protrusion extending from a surface of the channel.

9. The scrub head of claim 6 wherein the protruding structure is sized to engage and deflect the guide and compress the blade as the blade and guide subassembly is inserted into or removed from the channel.

10. The scrub head of claim 6 wherein the guide is shorter in length than the blade and the protruding structure is at least partially exposed when the blade and guide subassembly is inserted into the channel.

11. The scrub head of claim 6 wherein the channel is generally G-shaped and with a portion of the channel engaging a groove of the blade.

12. The scrub head of claim 6 wherein the guide and blade are replaced together during a blade exchange procedure.

13. A scrub head for a floor maintenance machine comprising:

a chassis having a vacuum outlet;

a retainer coupled to the chassis, together said retainer and chassis defining a channel, with at least one end of the channel defining a protruding structure;

a squeegee blade adapted to engage an interior surface of a guide; and wherein blade and guide are sized to be inserted into and retained within the channel, with the protruding structure tending to maintain the blade and guide within the channel, and said protruding structure tending to compress the blade and guide during a blade exchange procedure wherein the blade and guide are removed from the channel by a pulling motion directed substantially perpendicular to a direction of machine operation.

14. The scrub head for a floor maintenance machine of claim 13 wherein the protruding structure includes a pair of protrusions positioned at opposite ends of the channel.

15. The scrub head for a floor maintenance machine of claim 13 wherein the protruding structure is defined on a surface of the retainer.

* * * * *